US008692745B2

(12) United States Patent
Kim

(10) Patent No.: US 8,692,745 B2
(45) Date of Patent: Apr. 8, 2014

(54) LIGHT EMITTING DEVICE REDUCING AN ELECTRIC POWER CONSUMPTION AND METHOD OF DRIVING THE SAME

(75) Inventor: Hak Su Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 896 days.

(21) Appl. No.: 11/318,517

(22) Filed: Dec. 28, 2005

(65) Prior Publication Data

US 2006/0156120 A1 Jul. 13, 2006

(30) Foreign Application Priority Data

Dec. 29, 2004 (KR) ..... 10-2004-0115687

(51) Int. Cl.
*G09G 3/30* (2006.01)

(52) U.S. Cl.
USPC ..... 345/77

(58) Field of Classification Search
USPC ..... 714/726; 345/36–45, 76, 77
See application file for complete search history.

(56) References Cited

U.S. PATENT DOCUMENTS

| | | | | |
|---|---|---|---|---|
| 5,568,163 | A * | 10/1996 | Okumura | 345/100 |
| 5,828,367 | A * | 10/1998 | Kuga | 345/211 |
| 5,844,368 | A * | 12/1998 | Okuda et al. | 315/169.3 |
| 6,545,653 | B1 * | 4/2003 | Takahara et al. | 345/87 |
| 6,661,428 | B1 * | 12/2003 | Kim | 345/690 |
| 6,903,716 | B2 * | 6/2005 | Kawabe et al. | 345/99 |
| 2002/0000970 | A1 * | 1/2002 | Akimoto et al. | 345/100 |
| 2002/0044143 | A1 | 4/2002 | Kota et al. | |
| 2002/0044782 | A1 * | 4/2002 | Kota et al. | 396/661 |
| 2002/0135547 | A1 * | 9/2002 | Tanabe | 345/75.2 |
| 2002/0175635 | A1 * | 11/2002 | Komiya | 315/169.3 |
| 2003/0030609 | A1 * | 2/2003 | Lee | 345/87 |
| 2003/0034943 | A1 * | 2/2003 | Takeda | 345/87 |
| 2003/0076030 | A1 * | 4/2003 | Kim et al. | 313/491 |
| 2005/0007319 | A1 * | 1/2005 | Shin et al. | 345/76 |

FOREIGN PATENT DOCUMENTS

| | | |
|---|---|---|
| EP | 0 651 367 B1 | 1/1999 |
| EP | 1 134 719 A1 | 9/2001 |
| EP | 1 260 958 A2 | 11/2002 |
| EP | 1 439 516 A2 | 7/2004 |

(Continued)

OTHER PUBLICATIONS

Japanese Office Action dated Sep. 13, 2011.

(Continued)

*Primary Examiner* — Chanh Nguyen
*Assistant Examiner* — Ram Mistry
(74) *Attorney, Agent, or Firm* — Morgan, Lewis & Bockius LLP

(57) ABSTRACT

The present invention relates to a light emitting device for reducing consumption of an electric power in screen protecting mode. The light emitting device includes a plurality of data lines, a plurality of scan lines, a plurality of pixels, a controller, a data driving circuit and a scan driving circuit. The data lines are disposed in a first direction. The scan lines are disposed in a second direction different from the first direction. The pixels are formed by the data lines and the scan lines. The controller transmits a plurality of first display data. The data driving circuit provides data current corresponding to the first display data transmitted from the controller to the data lines. The scan driving circuit drives the scan lines by a unit of two or more lines under control of the controller when the first display data are repeatedly transmitted to the data driving circuit.

8 Claims, 4 Drawing Sheets

(56) References Cited

FOREIGN PATENT DOCUMENTS

| | | | |
|---|---|---|---|
| EP | 1 170 717 | B1 | 5/2007 |
| JP | 2002-123212 | A | 4/2002 |
| JP | 2004-302173 | A | 10/2004 |

OTHER PUBLICATIONS

European Office Action dated Nov. 2, 2011.

Anonymous: "Driving method for polyLED displays," Research Disclosure, Mason Publications, Hampshire, GB, vol. 453, No. 30, Jan. 1, 2002, XP007129567, ISSN: 0374-4353.

* cited by examiner

LIGHT EMITTING DEVICE REDUCING AN ELECTRIC POWER CONSUMPTION AND METHOD OF DRIVING THE SAME

BACKGROUND OF THE INVENTION

1. Field of the Invention

The present invention relates to a light emitting device and a method of driving the same. Particularly, the present invention relates to a light emitting device which can reduce consumption of an electric power in screen protecting mode and a method of driving the same.

2. Description of the Related Art

A light emitting device emits a light having a certain wavelength when a predetermined voltage is applied thereto.

FIG. 1 is a plan view illustrating pixel in a common organic electroluminescent device. FIG. 2 is a plan view illustrating a process of emitting a light in the pixel.

Referring to FIG. 1, the organic electroluminescent device includes a panel having a plurality of pixels 3.

At least one pixel includes an anode electrode layer 4, an organic layer 10, and a cathode electrode layer 12, disposed in sequence.

The organic layer 10 includes an electron injection layer 10A, an electrode transporting layer 10B, an emitting layer 10C, a hole transporting layer 10D and a hole injection layer 10E.

When certain voltages are applied to the anode electrode layer 4 and the cathode electrode layer 12, electrodes generated from the cathode electrode layer 12 are transported to the emitting layer 10C through the electron injection layer 10A and the electron transporting layer 10B. In addition, holes generated from the anode electrode layer 4 are transported to the emitting layer 10C through the hole injection layer 10E and the hole transporting layer 10D. Then, the electrodes and holes are recombined in the emitting layer 10C, and so a light is emitted from the emitting layer 10C.

The anode electrode layer 4 is made up of a transparent conductible substance such as indium tin oxide (ITO), indium zinc oxide (IZO), and indium tin zinc oxide (ITZO).

The hole injection layer 10E adjusts the concentration of the holes, and the hole transporting layer 10D controls the moving velocity of the holes. As a result, the holes generated from the anode electrode layer 4 are easily injected into the emitting layer 10C.

The electron injection layer 10A adjusts the concentration of the electrons, and the electron transporting layer 10B controls the moving velocity of the electrons. As a result, the electrons generated from the cathode electrode layer 12 are easily injected into the emitting layer 10C.

The organic electroluminescent device emits a light through the above process. On the other hand, in the organic electroluminescent device, in case that a same image is continuously displayed on a part of the panel, elements corresponding to the part are deteriorated more rapidly than ones corresponding to the other part. In detail, particular pixel is continuously turned on in accordance with first data signals in some area of the panel. However, certain pixel is continuously turned off in accordance with second data signals in some area of the pixel. Accordingly, the pixels have different deterioration velocity. In other words, in case that an image is continuously displayed on a part of the pixel, pixels which are turned on are deteriorated more rapidly than ones which are turned off. As a result, in the organic electroluminescent device, an image distortion phenomenon may be occurred on the screen of the panel which is used for a long period of time.

Additionally, the consumption of electric power is high in the organic electroluminescent device.

SUMMARY OF THE INVENTION

It is a feature of the present invention to provide a light emitting device and method of driving the same for reducing consumption of an electric power in a screen protection mode.

A driver for driving a plurality of pixels formed by data lines and scan lines according to one embodiment of the present invention includes a controller, a data driving circuit and a scan driving circuit. The controller transmits a plurality of first display data. The data driving circuit provides data current corresponding to the first display data transmitted from the controller to the data lines. The scan driving circuit drives the scan lines under control of the controller. Here, the scan lines are driven by a unit of two or more lines when the plural first display data are repeatedly transmitted to the data driving circuit.

A driver for driving a panel having a plurality of pixels formed by data lines and scan lines according to another embodiment of the present invention includes a controller and a scan driving circuit. The controller detects whether or not a first image is continuously displayed on the panel during a predetermined time. The scan driving circuit drives the scan lines by a unit of two or more lines under control of the controller when the first image is displayed on the panel during the time.

A light emitting device according to one embodiment of the present invention includes a plurality of data lines, a plurality of scan lines, a plurality of pixels, a controller, a data driving circuit and a scan driving circuit. The data lines are disposed in a first direction. The scan lines are disposed in a second direction different from the first direction. The pixels are formed by the data lines and the scan lines. The controller transmits a plurality of first display data. The data driving circuit provides data current corresponding to the first display data transmitted from the controller to the data lines. The scan driving circuit drives the scan lines by a unit of two or more lines under control of the controller when the first display data are repeatedly transmitted to the data driving circuit.

A driver for driving a plurality of pixels formed by data lines and scan lines according to still another embodiment of the present invention includes a controller, a data driving circuit and a scan driving circuit. The controller transmits a plurality of first display data. The data driving circuit provides data signals corresponding to the first display data transmitted from the controller to the data lines. The scan driving circuit drives the scan signals under control of the controller. Here, luminescent areas of waveforms of the scan signals are overlapped.

A method of driving a light emitting device including a panel having a plurality of pixels formed by data lines and scan lines according to one embodiment of the present invention includes detecting whether or not a first image is displayed on the panel during a first time; and driving the scan lines by a unit of two or more lines in accordance with a result detected above.

A method of driving a light emitting device having data lines and scan lines which cross over the data lines according to another embodiment of the present invention providing scan signals to the scan lines; and providing data signals the data lines, wherein the data signals are synchronized with the scan signals. Here, each of waveforms of the scan signals has a luminescent area, and the luminescent areas are overlapped by a unit of two or more areas.

A light emitting device and a method of driving the same according to the present invention uses a protecting image, and thus elements included in a panel is not deteriorated and the consumption of an electric power is reduced in a screen protection mode.

BRIEF DESCRIPTION OF THE DRAWINGS

The above and other features and advantages of the present invention will become readily apparent by reference to the following detailed description when considered in conjunction with the accompanying drawings wherein.

DESCRIPTION OF EMBODIMENTS

Hereinafter, the preferred embodiments of the present invention will be explained in more detail with reference to the accompanying drawings.

Figure 1:
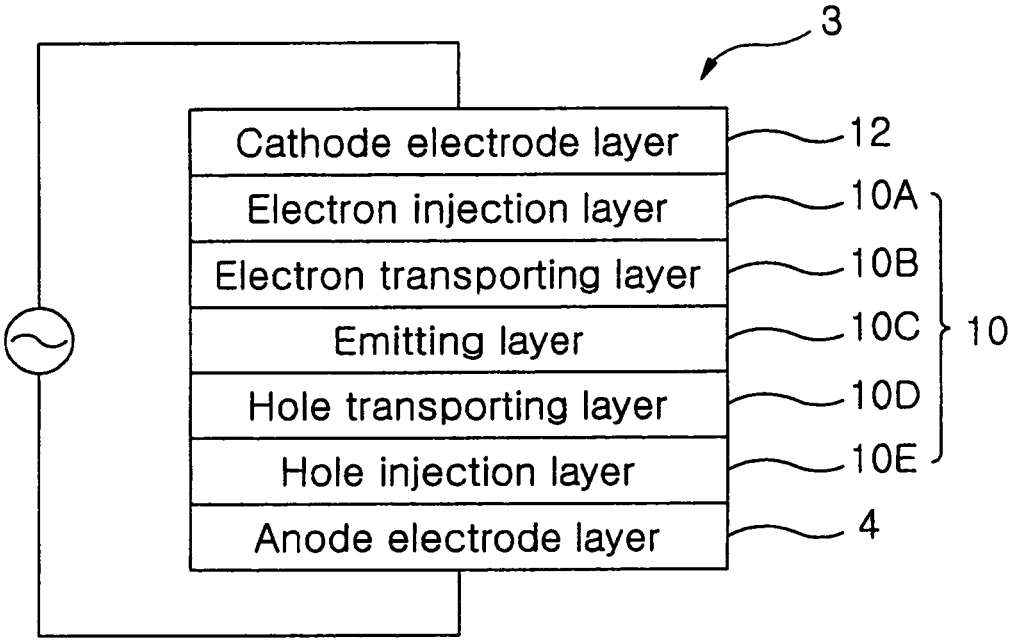
FIG. 1 is a plan view illustrating pixel in a common organic electroluminescent device.
Figure 2:
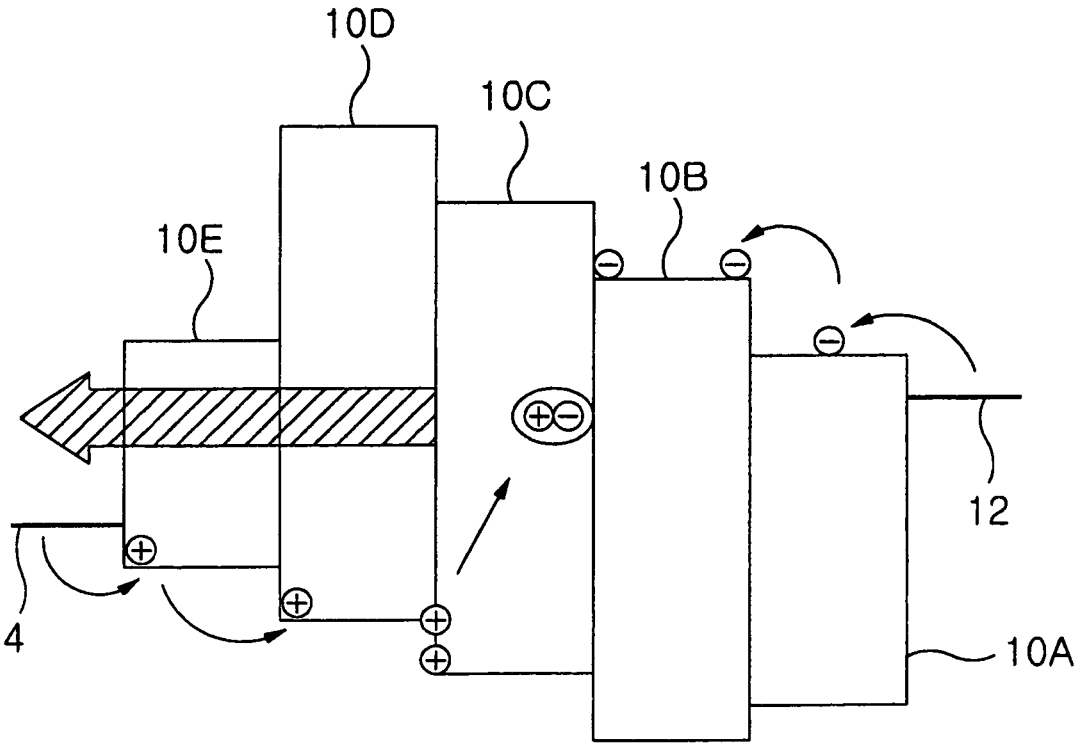
FIG. 2 is a plan view illustrating a process of emitting a light in the pixel.
Figure 3:
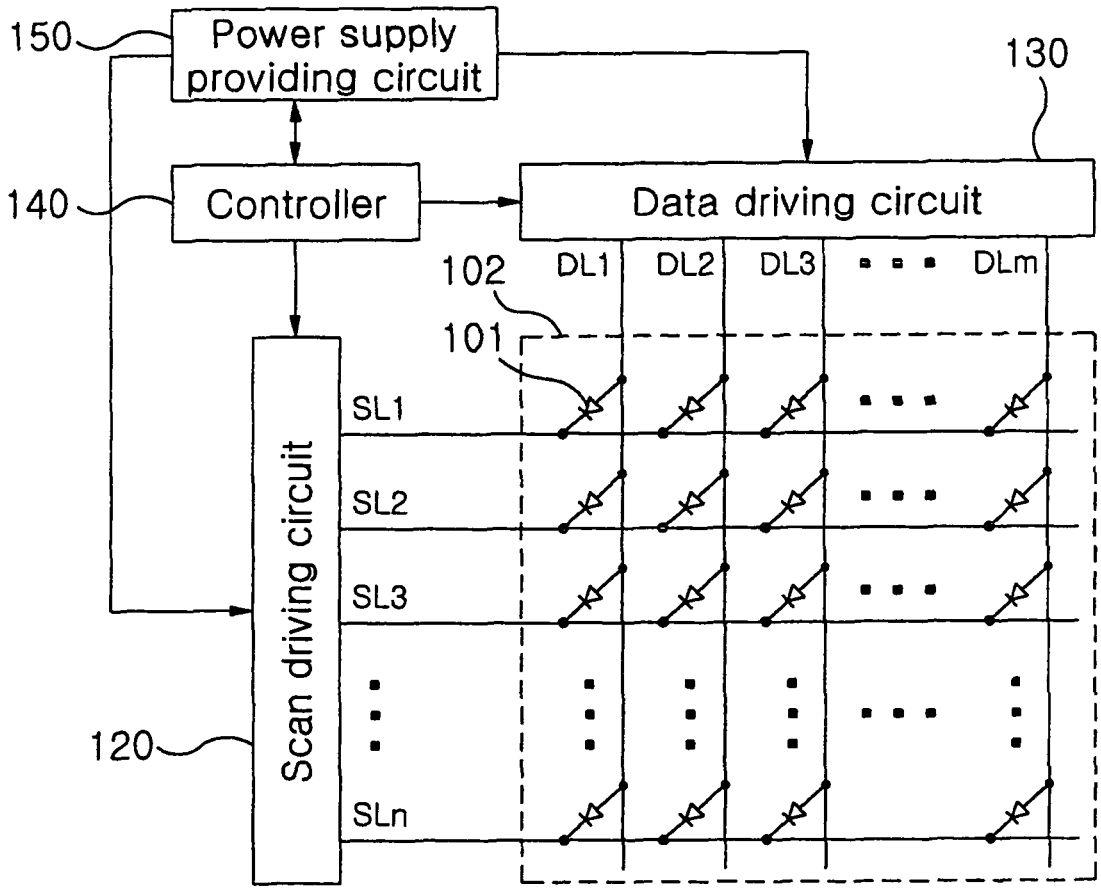
FIG. 3 is a plan view illustrating a light emitting device according to one embodiment of the present invention.

FIG. 3 is a plan view illustrating a light emitting device according to one embodiment of the present invention.

Referring to FIG. 3, the light emitting device of the present invention includes a panel 102, a controller 140, a scan driving circuit 120, a data driving circuit 130, and a power supply providing circuit 150.

The light emitting device according to one embodiment of the present invention includes an organic electroluminescent device, a plasma display panel, a liquid crystal display, and others. Hereinafter, the organic electroluminescent device will be described as an example of the light emitting device for convenience of the description.

The panel 102 includes a plurality of pixels 101 formed in cross areas of data lines (DL1 to DLm) and scan lines (SL1 to SLn). Each of the pixels 101 includes an anode electrode layer, an organic layer, and a cathode electrode layer, disposed in sequence on a substrate.

The organic layer includes a hole transporting layer (HTL), an emitting layer (EML), and an electron transporting layer (ETL), disposed in sequence on the anode electrode layer.

In case that a positive voltage and a negative voltage are applied to the anode electrode layer and cathode electrode layer, respectively, the HTL transports holes provided from the anode electrode layer into the EML, and the ETL transports electrons provided from the cathode electrode layer into the EML.

Subsequently, the transported holes and electrons are recombined in the EML, and so a light having a certain wavelength is emitted from the EML.

The controller 140 receives display data from the outside, and transmits the received display data to the data driving circuit 130. In addition, the controller 140 controls the scan driving circuit 120 and the data driving circuit 130.

The controller 140 according to another embodiment of the present invention stores the received display data therein or in outside memory (not shown).

The power supply providing circuit 150 supplies a power supply to the scan driving circuit 120 and the data driving circuit 130.

Figure 4A:
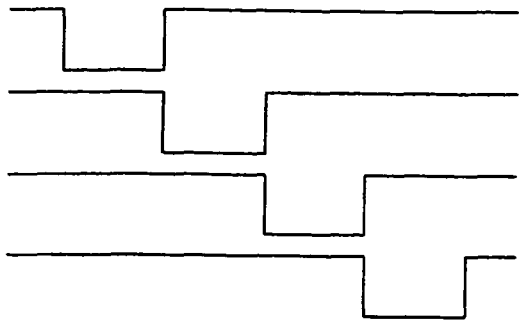
FIG. 4A is a plan view illustrating scan signals in a normal screen displaying mode.
Figure 4B:
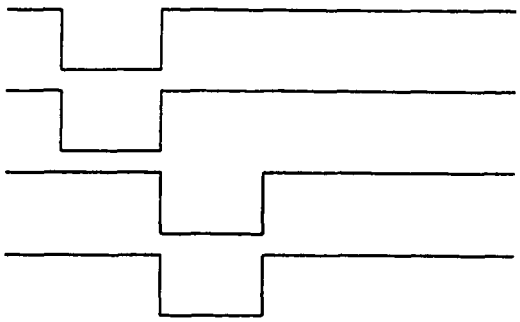
FIG. 4B is a plan view illustrating scan signals in a screen protection mode.

The scan driving circuit 120 operates differently at normal screen displaying mode and screen protection mode. In case of the normal screen displaying mode, the scan driving circuit 120 drives the scan lines (SL1 to SLn) by a unit of one line, as shown in FIG. 4A. And, in case of the screen protection mode, the scan driving circuit 120 drives the scan lines (SL1 to SLn) by a unit of two or more lines, as shown in FIG. 4B.

In the light emitting device according to another embodiment of the present invention, luminescent areas of waveforms of at least two scan lines may be overlapped one another when same display data are repeatedly transmitted to the data driving circuit 130. Here, the luminescent areas mean areas corresponding to low logics of the scan lines (SL1 to SLn).

The data driving circuit 130 provides data signals, i.e. data current corresponding to the display data transmitted from the controller 140 to the data lines (DL1 to DLm). Here, the data signals are synchronized with the scan signals under control of the controller 140.

The controller 140 detects whether or not same data signals are repeatedly provided to the data lines (DL1 to DLm) during a predetermined period of time, and operates the normal screen displaying mode or the screen protection mode in accordance with the detection result. In case of the screen protection mode, the controller 140 controls the brightness of the panel 102 low, or provides display data corresponding to a pre-stored protecting image to the data driving circuit 130.

The power supply providing circuit 150 generates driving voltage such as a high scan driving voltage (VGH), a low scan driving voltage (VGL), etc., and controls the magnitude of the scan driving voltages. Additionally, the power supply providing circuit 150 may control the duty ratio of the scan driving voltages. As a result, the switching time, i.e. on-off time between the scan lines (SL1 to SLn) and the scan driving circuit 120, is changed depending on the duty ratio.

Figure 5:
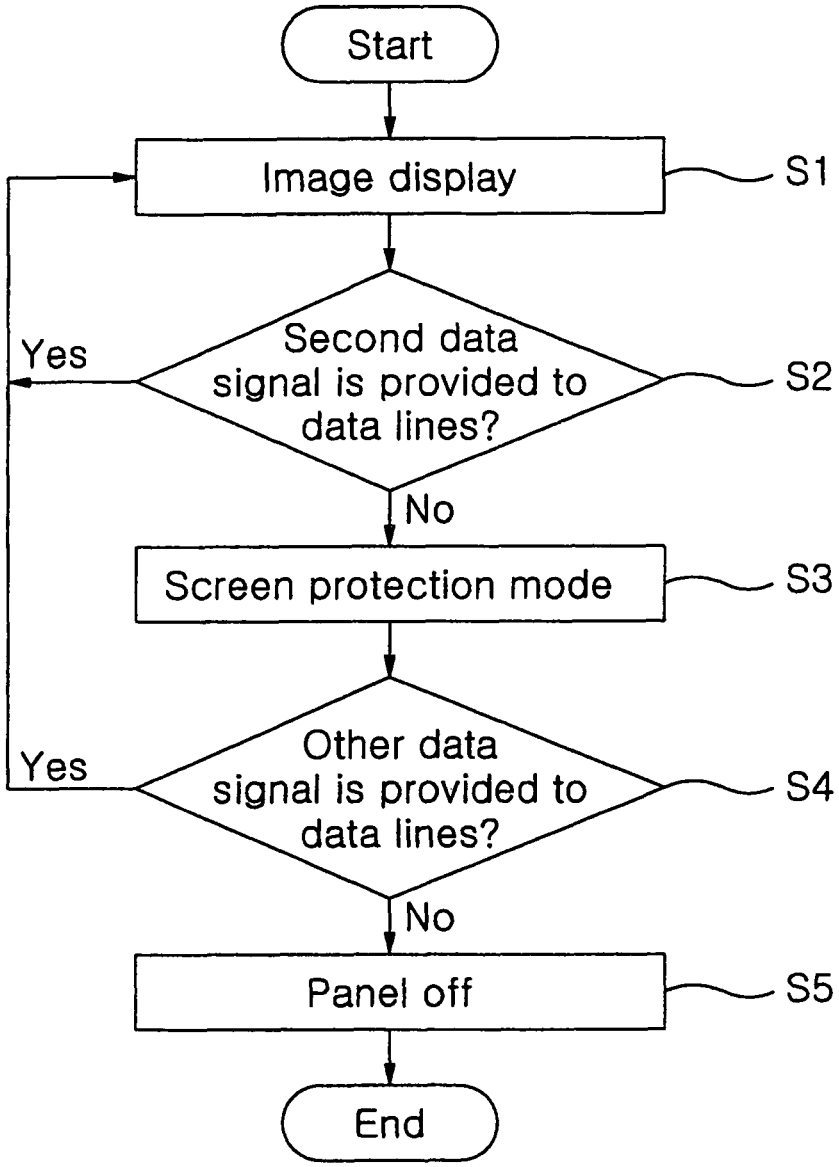
FIG. 5 is a flowchart illustrating a process of driving the light emitting device according to one embodiment of the present invention.

FIG. 5 is a flowchart illustrating a process of driving the light emitting device according to one embodiment of the present invention.

Referring to FIG. 5, in the step of S1, the protecting image corresponding to particular display data is displayed on the panel 102 in a method of driving the light emitting device. Here, the protecting image is an image corresponding to display data stored in advance in a memory (not shown), or an image corresponding to display data transmitted to the controller 140.

In the step of S1, in case that first data signals are repeatedly provided to the data lines (DL1 to DLm) during a predetermined period of time, the screen protection mode is performed.

Then, in the step of S2, it is detected whether or not second data signals different from the first data signals are provided to the data lines (DL1 to DLm) during such predetermined period of time.

In case that the second data signals are provided to the data lines (DL1 to DLm), the step of S1 is performed again.

Here, the predetermined period of time is changed depending on the design of user. For example, the predetermined period of time may be several seconds to tens of seconds.

In addition, the second data signals are display data corresponding data inputted to the controller 140 from the outside so that the light emitting device performs particular operation. An image displayed on the panel 102 may be changed in accordance with the second data signals.

In the step of S3, in case that the second data signals are not provided to the data lines (DL1 to DLm) during the predetermined period of time, the screen protection mode is performed, i.e. the protecting image is displayed on the panel 102.

The protecting image is an image structured to prevent deterioration of the elements such as pixels, etc. included in the panel 102. The protecting image according to one embodiment of the present invention has relatively low brightness.

For example, in the normal screen displaying mode, the magnitude of current passing through one data line to the corresponding scan line is assumed as 100 μA.

In this case, in the screen protection mode, at least two scan lines are operated simultaneously, and thus the magnitude of current passing through the data line to each scan line is a maximum of 50 μA. For example, when two scan lines are operated simultaneously, the magnitude of current passing through the data line to each scan line is 50 μA.

In the normal screen displaying mode, when the brightness of the panel 102 is 100 nit, the current passing through one scan line is 100 μA, and the voltage corresponding to the brightness is 20V, the electric power is 200 mW (=100 μA×100×20).

On the other hand, in the screen protection mode, when the brightness of the panel 102 is 50 nit, i.e. half of the brightness in the normal screen displaying mode, the current passing through each scan line is 50 μA, and the voltage corresponding to the brightness is 18V, the electric power is 90 mW (=50 μA×100×18).

In case that the scan lines (SL1 to SLn) are operated by a unit of two lines, and the duty ratio of scan signals provided to the scan lines (SL1 to SLn) is doubled, the current of 25 μA and the voltage of 16V may be provided to each of the scan lines (SL1 to SLn) in order to generate the brightness of 50 nit. In this case, the electric power is 40 mW (=25 μA×100×16).

In the step of S4, it is detected whether or not data signals different from the second data signals are provided to the data lines (DL1 to DLm) while the protecting image is displayed.

In the step of S5, when the other data signals are not provided to the data lines (DL1 to DLm), the panel 102 is turned off. In contrast, when the other data signals are provided to the data lines (DL1 to DLm), an image corresponding to the other data signals is displayed on the panel 102.

In short, in the method of driving the light emitting device of the present invention, the protecting image is used, and thus the elements included in the panel 102 are not deteriorated. In addition, because the scan lines (SL1 to SLn) are driven by a unit of two or more lines, the consumption of electric power of the light emitting device may be reduced.

From the preferred embodiments for the present invention, it is noted that modifications and variations can be made by a person skilled in the art in light of the above teachings. Therefore, it should be understood that changes may be made for a particular embodiment of the present invention within the scope and spirit of the present invention outlined by the appended claims.

What is claimed is:

1. A driver for driving a plurality of pixels formed by data lines and scan lines, the driver comprising:

a controller for receiving a plurality of display data, detecting whether or not same display data are input during a predetermined period, providing a first control signal and display data corresponding to a pre-stored protecting image to a data driving circuit when the same display data are detected during the predetermined period and a second control signal when the same display data are not detected during the predetermined period, and transmitting the plurality of display data;

the data driving circuit for transmitting data current corresponding to the plurality of display data transmitted from the controller to the data lines;

a scan driving circuit for driving the scan lines in accordance with the first and second control signals from the controller, all of the scan lines being connected with the scan driving circuit, the scan lines in a display part being sequentially driven by a unit of two or more adjacent lines when the first control signal is supplied to the scan driving circuit, the scan lines in the display part being sequentially driven by a unit of one line when the second control signal is supplied to the scan driving circuit; and a power supply providing circuit for supplying a scan driving voltage to the scan driving circuit, and controlling duty ratio of the scan driving voltage such that a brightness of a display data is low only when the same display data are detected during the predetermined period, wherein driven periods of the two or more adjacent lines are synchronized with each other only when the first control signal is supplied to the scan driving circuit, wherein the two or more adjacent lines comprises a first line and a second line, wherein the second line is connected with all pixels arranged between the first and the second lines, wherein the scan driver simultaneously supplies only a same scan signal to the scan lines that are driven by the unit of two or more adjacent lines, the same scan signal being supplied for a same period, and wherein the same scan signal is supplied to pixels connected with the two or more adjacent lines in the display part.

2. The driver of claim 1, wherein the scan lines are coupled to a luminescent source comprising a low scan driving voltage by a unit of two or more lines when the same display data are transmitted to the data driving circuit.

3. The driver of claim 1, wherein:

the scan driving circuit transmits scan signals to the scan lines; and the duty rate of the scan signals is changed when the same display data are transmitted to the data driving circuit.

4. The driver of claim 1, wherein a remaining display data excluding the same display data of the plurality of display data comprises a brightness different from the same display data.

5. The driver of claim 4, wherein the brightness of the remaining display data is higher than that of the same display data.

6. The driver of claim 4, wherein the controller stores the remaining display data.

7. A light emitting device, comprising:

a plurality of data lines disposed in a first direction;

a plurality of scan lines disposed in a second direction different from the first direction;

a plurality of pixels formed by the data lines and the scan lines;

a controller for receiving a plurality of display data, detecting whether or not same display data are input during a predetermined period, providing a first control signal and display data corresponding to a pre-stored protecting image to a data driving circuit when the same display data are detected during the predetermined period and a second control signal when the same display data are not detected during the predetermined period, and transmitting the plurality of display data;

the data driving circuit for transmitting data current corresponding to the plurality of display data transmitted from the controller to the data lines;

a scan driving circuit for simultaneously driving the scan lines in a display part by a unit of two or more adjacent lines when the first control signal is supplied to the scan driving circuit, and sequentially driving the scan lines in the display part by a unit of one line when the second control signal is supplied to the scan driving circuit; and a power supply providing circuit for supplying a scan driving voltage to the scan driving circuit, and controlling duty ratio of the scan driving voltage such that a brightness of a display data is low only when the same display data are detected during the predetermined period, wherein driven periods of the two or more adjacent lines are synchronized with each other only when the first control signal is supplied to the scan driving circuit, and all of the scan lines are connected with the scan driving circuit, wherein the two or more adjacent lines comprises a first line and a second line, wherein the second line is connected with all pixels arranged between the first and the second lines, wherein the scan driver simultaneously supplies only a same scan signal to the scan lines that are driven by the unit of two or more adjacent lines, the same scan signal being supplied for a same period, and wherein the same scan signal is supplied to pixels connected with the two or more adjacent lines in the display part.

8. A method of driving a light emitting device including a panel having a plurality of pixels formed by data lines and scan lines, the method comprising:

detecting whether or not a same display data is input during a predetermined time;

providing a first control signal and display data corresponding to a pre-stored protecting image when the same display data are detected during the predetermined period, and a second control signal when the same display data are not detected during the predetermined period;

simultaneously driving the scan lines in a display part by a unit of two or more adjacent lines when the first control signal is supplied, and simultaneously driving the scan lines in the display part by a unit of one line when the second control signal is supplied; and supplying a scan driving voltage and controlling duty ratio of the scan driving voltage such that a brightness of a display data is lower only when the same display data are detected during the predetermined period, wherein driven periods of the two or more adjacent lines are synchronized with each other only when the first control signal is supplied to a scan driving circuit, wherein the two or more adjacent lines comprises a first line and a second line, wherein the second line is connected with all pixels arranged between the first and the second lines, wherein only a same scan signal is supplied for a same period, and is simultaneously supplied to the scan lines that are driven by the unit of two or more adjacent lines, and wherein the same scan signal is supplied to pixels connected with the two or more adjacent lines.

* * * * *